United States Patent [19]

Davy et al.

[11] Patent Number: 4,697,229

[45] Date of Patent: Sep. 29, 1987

[54] ELECTRONIC CONTROL EQUIPMENT

[75] Inventors: Peter G. Davy, Stroud; Brian G. Cuthbertson, London, both of England

[73] Assignee: Neon 2000 Limited, London, England

[21] Appl. No.: 826,282

[22] Filed: Feb. 5, 1986

[30] Foreign Application Priority Data

Feb. 8, 1985 [GB] United Kingdom ..... 8503339

[51] Int. Cl.[4] ..... G05F 1/569

[52] U.S. Cl. ..... 363/49; 323/238; 323/321; 323/901; 323/908

[58] Field of Search ..... 363/49, 50, 52–58; 323/235, 238, 319, 321, 901, 908

[56] References Cited

U.S. PATENT DOCUMENTS

| | | | |
|---|---|---|---|
| 3,823,359 | 7/1974 | Koeller et al. | 363/53 |
| 3,959,714 | 5/1976 | Mihelich | 323/901 X |
| 4,180,852 | 12/1979 | Koizumi et al. | 363/49 |
| 4,233,557 | 11/1980 | Alberkrack | 363/49 X |
| 4,272,805 | 6/1981 | Iguchi et al. | 363/49 X |

*Primary Examiner*—Peter S. Wong

*Attorney, Agent, or Firm*—Lee, Smith & Zickert

[57] ABSTRACT

Electrical control apparatus including a power supply, a regulating element, a manually-operable control device which can be set to provide a preset output from the regulating element, and an automatic control circuit for modifying the operation of the control elements in the event of a power failure. The automatic control circuit is so arranged as to rapidly reduce the output to zero when the absolute supply voltage falls below a predetermined level, and to progressively raise the output to the preset level when the supply voltage is restored.

10 Claims, 3 Drawing Figures

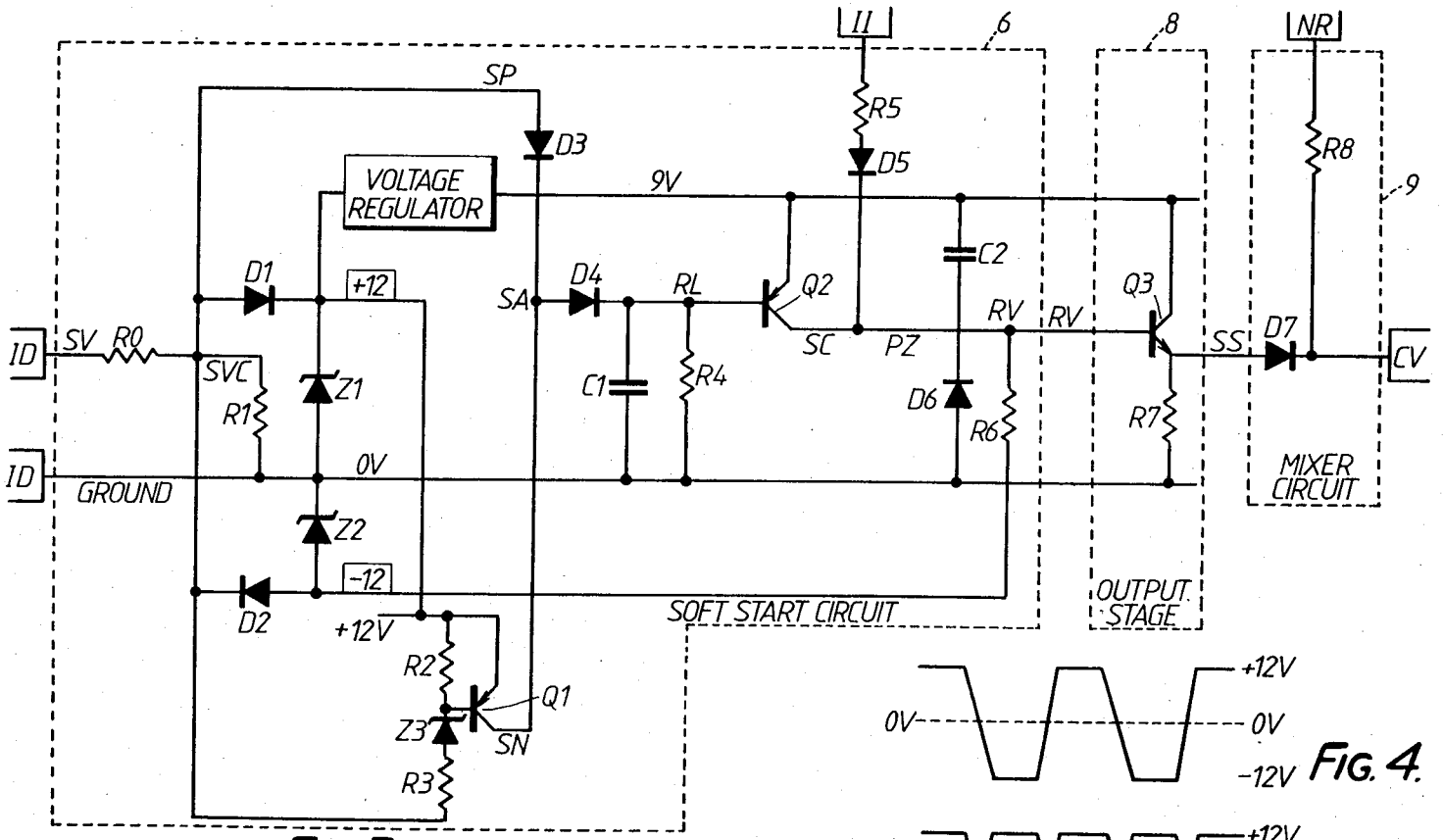
FIG. 3.
FIG. 4.
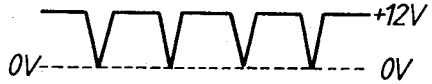
FIG. 5.

ELECTRONIC CONTROL EQUIPMENT

The present invention relates to electronic or electrical control apparatus in which the output is controlled by an analogue control voltage and particularly to equipment for regulating the electric current in a load circuit.

Preferably the apparatus is adapted to vary the current continuously or in small steps from a zero or minimum current level to a maximum or full current level according to the level of the control voltage.

Equipment of this nature uses switching or regulating devices which are limited in the maximum current they can switch or conduct to the load. Many loads initially draw an inordinately large current from the supply when the full supply voltage is suddenly fed to them by a switching device after a period of supply interruption. This large initial current may be into resistive loads having a low initial resistance due to low initial temperature (e.g. lamp filaments) or into inductive loads, or into capacitors while they charge to normal running voltage.

The rating of mechanical switches is limited mainly by the susceptibility of the contacts to weld together when contact is made and they are thus derated for inductive loads. Semiconductor switching or regulating devices (e.g. transistors, thyristors, triacs), although they can conduct large currents for short periods will have to be derated for many loads with adverse starting characteristics especially when uncertainty over worst case initial currents makes it difficult to guarantee conformance to the safe operating conditions for the device. High starting currents therefore necessitate derating for many loads and are probably responsible for the early failure of many devices. Sudden switch-on is often also detrimental to the load itself and may be undesirable for other reasons as well, e.g. sudden light increase causes dazzling.

The present invention seeks to provide a relatively cheap and simple electronic circuit which provides an analogue control voltage for a regulator which in turn varies the current in a load according to the analogue control voltage, in such a way as to obviate initial high currents by slowly ramping the control voltage from its zero or minimum current level to its maximum or full current level. The circuit is preferably arranged to detect any interruption of the power supply to the load of more than 1 ms or so, and to then immediately force the control voltage to its zero or minimum current level from which it is again ramped at the next switch-on.

One embodiment of the invention will now be described by way of example with reference to the accompanying drawings in which:

FIG. 3 is a circuit diagram of one form of the system of FIG. 1, and

FIGS. 4 and 5 are voltage waveforms during different operations of the circuit of FIG. 3.

Figure 1:
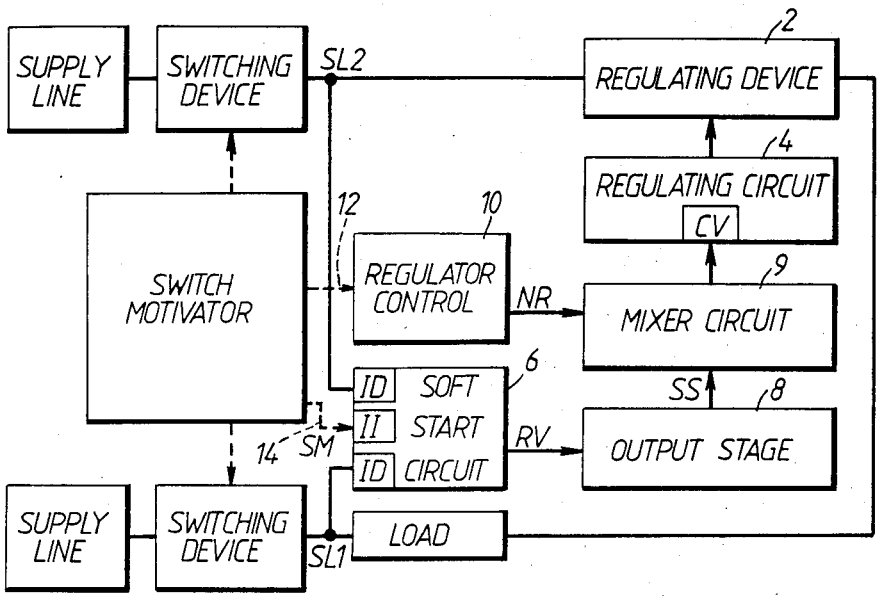
FIG. 1 is a block diagram of a control system including the circuitry of the present invention.

Referring to FIG. 1 a regulating device (2) is controlled by a regulating circuit (4) in such a way that the load current is varied according to the control voltage on the regulating circuit input CV. The circuit 6 referred to hereinafter as the soft start circuit has one output, the ramp voltage RV which controls an output stage (8) and ultimately controls the ramping of CV. Two of its three inputs, labelled ID, are interrupt detectors which are connected across the power lines to detect any interruption of the power supply voltage across them; the third is the inhibit input II, whose function is described below. The output voltage RV varies between a level representing zero or minimum current (ZMC) and a level representing full or maximum current (FMC). The output stage conditions RV to produce a soft start voltage SS which is suitable for interfacing to a mixer circuit (9) or directly to CV. The path of the load current (AC or DC) is shown by the thicker lines in FIG. 1 and the directions of action of the control signals are shown by arrows.

If the apparatus of the invention is added to an existing installation which functions as a regulator it will include a regulator control (10) whose output voltage NR must continue to determine the control voltage during normal running. The output stage voltage SS is therefore arranged to override the voltage NR for a short period after switch-on, so that CV is slowly ramped from its zero or minimum current (ZMC) level to the level of NR which it then follows while normal running continues. The maximum desirable rate of change of NR generated by the regulator control in the increasing current direction should preferably be equivalent to the soft start ramp slope so that the current is not suddenly increased by the regulator control during normal running.

If the regulator is adapted from or substituted for an original switching device which was controlled by a command from a switch motivator, (for example a manually operated switch) this command must be re-routed. Either the command must now direct an added regulator control, via dashed output 12, to switch NR between its zero and full current (ZMC & FMC) levels (at less than maximum desirable rate in the increasing current direction) thus changing CV via the mixer circuit, or the command must now be converted (if not already so) into a single two state (representing ON & OFF) switch motivating signal SM (line 14) which is fed to the inhibit input II of the soft start circuit and in its OFF state forces RV to its ZMC level and in its ON state allows RV to be ramped to its FMC level. In this latter case SS can be fed directly to CV and an added regulator control and mixer circuit are unnecessary.

If an original switching device is kept and a separate regulating device is added, the soft start circuit inputs ID are connected in such a way that they detect interruptions of the power supply due to operation of the switching device (i.e. to SL1 and SL2. Any switch motivator commands continue to operate the switching device(s) and need not to be fed to the inhibit input.

The ground rail (SL1 or SL2) of the soft start circuit serves as the reference for its output voltage RV and also serves as one of the interrupt detectors ID. The other interrupt detector then exhibits a signal with respect to this ground which in normal running is an AC, positive DC or negative DC voltage, and, which when the supply is interrupted, is pulled to ground. (Most regulating devices will use either SL1 or SL2 as the ground reference for control signals between the regulating circuit and the regulating device. In many cases it will be convenient to connect the ground potential ID to this supply line so that the regular control, regulating circuit, soft start circuit, output stage and all control signals have a common ground).

Figure 2:
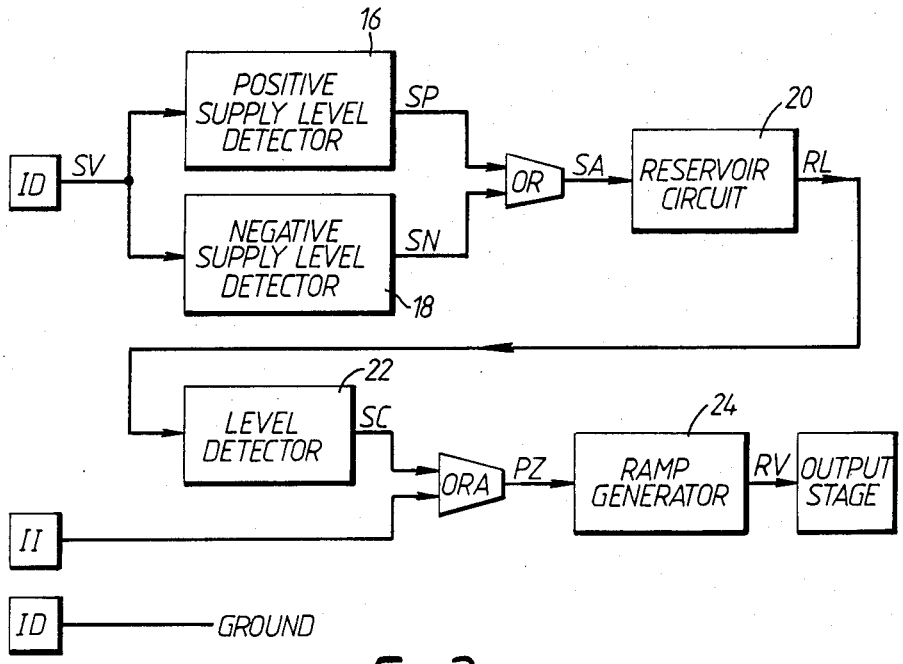
FIG. 2 is a functional block diagram of the present invention.

Referring to FIG. 2, SP (supply positive) and SN (supply negative) are two-state signals produced by positive and negative level detectors 16 and 18, whose state changes whenever the supply voltage signal SV is more positive than a positive critical value or more negative than a negative critical value. Thus whenever the absolute value of SV is high, the output of OR, the two-state signal SA (supply absolute) is in its AbsH (absolute high) state, and whenever SV is near ground potential is in its AbsL (absolute low) state.

When SA is in its AbsH state, the "reservoir level" RL which is the output of the reservoir circuit (20), is held at its SuU (supply up) level. As soon as SA goes to its AbsL state, the reservoir circuit begins to ramp RL downwards towards its SuD (supply down) level. If SA remains in its AbsL state for long enough, RL eventually reaches its SuD level at which point the output of the level detector (22), the two state signal SC (supply condition) change from its SupU (supply up) state to its SupD (supply down) state. Whenever SA returns to its AbsH state, RL is quickly forced back to its SuU level and SC to its SupU state. If SA returns to its AbsH state within a sufficiently short time, RL is forced back to SuU before it can reach SuD so that SC remains unchanged in its SuU state throughout the excursion of SA from its AbsH state. Thus the interrupt detection circuitry ignores at its output SC, very short interruptions of the supply, transient voltage 'spikes' in the supply, and the short periods around the zero crossing point of each cycle of an AC supply during which the absolute value of the supply voltage is low.

It is important (for when the circuit is monitoring AC supplies) that the positive and negative critical values against which SV is assessed are kept low compared with the peak values of the supply voltage appearing on SV so that the periods around zero crossing during which SA is in its AbsL state are kept short. Bearing in mind that the time for RL to ramp from SuU to SuD must be made appreciably longer than these periods to guarantee correct operation with the worst case spread of component values, keeping these periods short allows this RL ramp time to be kept short enough for detection of the shortest interruptions normally encountered. Symmetrical operation on positive and negative half cycles will normally dictate critical values of equal absolute magnitude. Where the circuit is for use only with DC power supplies of one polarity, one of the supply level detectors and OR may be omitted.

Whenever SC is in its SupD state or whenever input II (FIG. 1) is in its inhibit state, the output of ORA, the two-state signal PZ (pull to zero) is in its 'zero' state. When PZ goes to its zero state the output of the ramp generator (24), ramp voltage RV, is quickly pulled to its zero or minimum current (ZMC) level and stays at this level which PZ remains in its zero state. As soon as PZ goes to its 'full' state the ramp generator starts to ramp RV towards its maximum or full current (FMC) level which it reaches and maintains provided PZ remains in its full state.

In some embodiments the circuit may be arranged in such a way that II and PZ carry analogue signals which vary between levels representing FMC and ZMC. In this case ORA, instead of being a simple logic 'or' gate, is an analogue gate which, while SC is in its SupU state, gives PZ a level representing the current implied by the level imposed on II, and, when SC goes to its SupD state, pulls PZ quickly to its ZMC level. The ramp generator is then arranged in such a way that RV is driven to the level dictated by the level of PZ, quickly in the decreasing current direction and at its ramp speed in the increasing current direction. Thus when a regulator control is present (see FIG. 1) its output NR when fed to II will eventually impose the required normal running level on RV which can then be fed directly to CV.

FIG. 3 shows an embodiment of the circuit according to the invention (the soft start circuit) which is intended principally for monitoring mains voltage AC supplies and in which the rail voltages are +12 v, 9 v, 0 v, −12 v. The circuit elements are arranged in such a way that the output ramp voltage RV varies between a voltage level just negative of ground (representing FMC) and a positive voltage level (approx. 9 v) representing ZMC. The operation of the embodiment is described with reference to the circuit elements shown in FIG. 3, which includes references corresponding to those of FIGS. 1 and 2.

The supply voltage signal SV is clipped in both positive and negative directions by $R_o$, $D_1$, $Z_1$, $D_2$ and $Z_2$ to provide at SVC, for DC supplies greater than 12 v a steady +12 v or −12 v voltage, and for AC supplies (of sufficiently high voltage) a signal as shown in FIG. 4. These components also provide +12 v and −12 v unregulated rails from an AC supply. The 9 v rail can be derived from the +12 v rail by means of the voltage regulator shown.

When the supply is interrupted $R_1$ pulls SVC to ground potential (0 v) against the leakage through $D_1$ and $D_2$ from the supply smoothing capacitors (not shown). During the positive half-cycle (or for positive DC supplies) SVC, through $D_3$ and $D_4$ holds RL, the voltage on the reservoir capacitor $C_1$ at approx. +12 v, its SuU level. During the negative half-cycle the −12 v level at SVC causes sufficient reverse bias (24 v) across the zener $Z_3$ (convenient zener voltage 17 v) for Z3 to conduct base current from $Q_1$ which then, through $D_4$, holds $R_L$ at approx +12 v (SuU level). $R_3$ limits this base current and $R_2$ holds $Q_1$ off when SVC is insufficiently negative for $Z_3$ to conduct. For DC supplies the signal appearing at SA during normal running is a steady +12 v which holds RL, the voltage on the reservoir capacitor $C_1$, continuously at its SuU level. For AC supplies, this signal, when a resistance exists between SA and ground, is as shown in FIG. 5. The signal approximates to a square wave mark-space signal (approx. 1% duty cycle) and may be taken as an output to other circuitry including digital logic systems. (If this signal is not required as an output $D_4$ may be omitted). When the signal at SA is high, RL is at approx. +12 v (SuU level), $Q_2$ is off and SC is in its SupU state. When the signal at SA is 'low', $R_4$ discharges $C_1$, and when SA is 'low' for a prolonged period during interruptions, R4 eventually pulls RL to a level (SuD) at which base current flows in $Q_2$ which then pulls SC to approx. 9 v (its SupD state). A 9 v level on SC (its SupD state) or on II (its Inhibit state or ZMC level) produces a 9 v level at PZ (its Zero state or ZMC level) and at RV (its ZMC level). As soon as both $Q_2$ is off and II is at a near ground voltage (its enable state or FMC level), $R_6$ starts to ramp down the voltage RV on $C_2$ (fairly linearly since it discharges to −12 v) until RV is just below 0 v when $D_6$ prevents further ramp down. If II has imposed on it an analogue voltage representing the desired load current, $R_6$ ramps down RV only to a voltage just below that on II so that RV also exhibits a level representing this load current. $D_5$ prevents current flow out of II when II is at a lower voltage than RV, (this would affect ramp down), but may be omitted if the external signal to which II is connected has a very high impedance to ground. $R_5$ may be included to slow down the rate at which II pulls up the voltage at RV when II goes to its Inhibit state. This results in a gradual reduction of load current when this reduction is induced only by II and may be useful in some circumstances.

$Q_3$ and $R_7$ form an emitter follower output stage so that SS like RV varies between approx. 0 v and 9 v. $D_7$ and $R_8$ form a simple mixer circuit; provided the input impedance of CV is very high, $R_8$ transfers the normal running voltage NR virtually unchanged to CV except when SS pulls CV to higher voltages via D7. The error between RV & CV due to the voltage drop in $D_7$ and $Q_3$ is unimportant provided that the ZMC level for CV is any voltage above say 8 v.

The circuit elements $R_3Z_3R_2Q_1$ responsible for inverting negative signals from SVC, also monitor the voltage of the +12 v rail since this rail must be near its full voltage before sufficient voltage (17 v) appears across $Z_3$ for it to conduct. Thus just after switch-on say, while smoothing capacitors on the rail are charging and until the rail voltage is sufficiently established, $Q_1$ remains off so that for the whole of each negative half cycle SA is 'low' giving RL time to discharge to SuD level thus returning RV to ZMC level every cycle and giving RV insufficient time to ramp appreciably from this level. This function is useful if the +12 v rail or the 9 v rail derived from it also power other circuits (the Regulating Circuit for example) when it can hold load current at zero until the rails are established sufficiently for correct operation of these other circuits.

We claim:

1. A circuit for automatically controlling an electrical system including a regulating element so as to avoid abrupt increases in output when the power supply is reconnected after an interruption, comprising:

means for detecting a voltage on a supply rail and for producing an output when the voltage is greater than a predetermined value;

reservoir means whose output is connected to the output of said detecting means;

level detection means whose input is connected to the output of said reservoir means and which produces an output if the reservoir level falls below a predetermined value;

and control voltage generating means having an input connected to the output of said level detection means, said control voltage generating means being adapted to generate a control voltage for the regulating element which decreases abruptly when the generating means receives an inhibiting input and increases progressively at a predetermined rate from a low level, when the inhibiting input is removed;

whereby the occurrance of an interruption of the supply rail voltage causes an output from the level detection means which inhibits the control voltage generating means.

2. A circuit according to claim 1 for use with an A.C. supply comprising:

said detecting means comprises first and second detection means;

said first detection means producing an output when the supply voltage is more positive than a predetermined positive value;

said second means producing an output when the supply voltage is more negative than a predetermined negative value;

an OR gate circuit whose inputs are connected to the respective outputs of the two detection means;

said reservoir means comprises a reservoir circuit whose input is connected to the output of the OR gate, so that its output is maintained at a predetermined level so long as either detection circuits produce a suitable output; and said level detection means produces a control output for a ramp generator which causes the output of the ramp generator to fall when the reservoir level falls below said predetermined value.

3. A circuit according to claim 2 further comprising OR gate means having one input connected to the output of the level detector and the other input connected to the output of a manually-operable control, whereby the output of the ramp generator can be brought down when the manual control is switched to an OFF position.

4. Apparatus according to claim 2 wherein the output voltage is provided by a voltage of a capacitor charged from a voltage outside the range of the output voltage so that the output voltage reaches the value determining maximum current conduction in a finite time.

5. In an A.C. power control circuit for regulating the current supplied to a load by phase control wherein a control voltage on the input of a regulating circuit determines the proportion of time for which a regulating device conducts load current, the improvement comprising:

a. means for detecting an interruption of power on a pair of A.C. supply lines of a duration greater than a predetermined duration and for producing an output indicative of said interruption, and b. means for generating a voltage referenced to one of the A.C. supply lines which voltage determines the control voltage and changes in one direction abruptly when an interruption occurs and, when power is reconnected, changes in the other direction progressively at a predetermined rate from a value which determines a near zero proportion of time for current conduction.

6. Apparatus as in claim 5 wherein first mentioned means comprises a. detection means for producing an output referenced to one of the A.C. supply lines when the absolute value of the A.C. voltage on the other supply line referenced to the first mentioned supply line is greater than a predetermined value, b. reservoir means whose output voltage level is maintained at a predetermined level whenever an output exists on the detection means ans is progressively changed in one direction from output voltage level according to a predetermined function of time if the output on the detection means does not exist, and c. a level detector comprising a fixed voltage reference and a voltage comparator which produces an output if the reservoir output voltage level is changed from said predetermined level sufficiently to equal the fixed reference voltage.

7. Apparatus to claim 6 in which said detection means comprises:

a. first detection means for producing an output when the supply voltage is more positive than a predetermined positive value;

b. second detection means for producing an output when the supply voltage is more negative than a predetermined negative value; and c. an OR gate circuit whose inputs are connected to the outputs of the first and second detection means and whose output is connected to said reservoir means.

8. Apparatus as in claim 6 wherein the means for generating a referenced voltage comprises a ramp generator whose output voltage determines the referenced voltage and is abruptly pulled to and held at its near zero conduction value when a output exists on the level detector and, when this output disappears, is progressively changed from said near zero conduction value according to a predetermined function of time in such direction that the proportion of time for which the load current is conducted is increased until a current value is reached at which maximum conduction occurs.

9. Apparatus according to claim 8 in which said ramp generator includes an input which abruptly pulls and holds the output at its near zero conduction value or at an intermediate value.

10. Apparatus according to claim 8 including regulator control having a variable output voltage which in combination with the output voltage of the ramp generator determines the control voltage such that the one of said output voltages determining the lowest current conduction has precedence.

* * * * *